US007226316B2

(12) United States Patent
Wu

(10) Patent No.: US 7,226,316 B2
(45) Date of Patent: Jun. 5, 2007

(54) CABLE CONNECTOR ASSEMBLY WITH HOLDER

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/481,669

(22) Filed: Jul. 5, 2006

(65) Prior Publication Data

US 2007/0037450 A1 Feb. 15, 2007

Related U.S. Application Data

(63) Continuation-in-part of application No. 11/201,461, filed on Aug. 11, 2005.

(51) Int. Cl.
*H01R 9/03* (2006.01)

(52) U.S. Cl. ..... 439/610; 439/357; 439/484

(58) Field of Classification Search ..... 439/610, 439/483, 484, 357, 352, 334
See application file for complete search history.

(56) References Cited

U.S. PATENT DOCUMENTS

| | | | | |
|---|---|---|---|---|
| 4,842,547 | A | 6/1989 | Defibaugh et al. | |
| 5,074,808 | A | 12/1991 | Beamenderfer et al. | |
| 5,383,794 | A * | 1/1995 | Davis et al. | 439/352 |
| 5,389,006 | A * | 2/1995 | Noschese | 439/354 |
| 5,425,657 | A | 6/1995 | Davis et al. | |
| 5,564,939 | A | 10/1996 | Maitani et al. | |
| 5,797,771 | A | 8/1998 | Garside | |
| 5,934,942 | A * | 8/1999 | Patel et al. | 439/610 |
| 6,095,862 | A | 8/2000 | Doye et al. | |
| 6,165,006 | A | 12/2000 | Yeh et al. | |
| 6,290,530 | B1 * | 9/2001 | Chang | 439/378 |
| 6,524,128 | B2 | 2/2003 | Marowsky et al. | |
| 6,648,665 | B1 | 11/2003 | Wu | |
| 6,659,790 | B1 | 12/2003 | Wu | |
| 6,705,899 | B1 * | 3/2004 | Ji | 439/660 |
| 6,749,458 | B1 | 6/2004 | Kuo et al. | |
| 6,764,342 | B2 | 7/2004 | Murayama et al. | |
| 6,866,533 | B2 | 3/2005 | Wu | |
| 6,887,091 | B1 | 5/2005 | Wu | |
| 6,887,101 | B2 | 5/2005 | Ito et al. | |
| 2006/0019525 | A1 | 1/2006 | Lloyd et al. | |

* cited by examiner

*Primary Examiner*—Hae Moon Hyeon
(74) *Attorney, Agent, or Firm*—Wei Te Chung

(57) ABSTRACT

A cable connector assembly (100) includes a metal housing (1) defining a receiving space, a printed circuit board (2) retained in the receiving space, at least one cable (7) electrically connecting with the printed circuit board, a latch mechanism (3) comprising a latch member (31) assembled to the metal housing and a holder (4). The latch member includes an engaging portion engaging with the metal housing and a latch portion extending forwardly from the engaging portion for latching with the complementary connector. The holder (4) includes a bottom wall (52), a pair of side walls (51) extending upwardly from two sides of the bottom wall cooperatively to form a roomage (50) to receive the metal housing and the cable.

18 Claims, 8 Drawing Sheets

CABLE CONNECTOR ASSEMBLY WITH HOLDER

CROSS-REFERENCE TO RELATED APPLICATION

This application is a continuation-in-part (CIP) of U.S. patent application Ser. No. 11/201,461 filed on Aug. 11, 2005, invented by Jerry Wu, entitled "CABLE CONNECTOR ASSEMBLY WITH LATCHING MECHANISM", which is assigned to the same assignee as this application.

FIELD OF THE INVENTION

The present invention generally relates to a cable connector assembly, and more particularly to a cable connector assembly used for high-speed signal transmission.

DESCRIPTION OF RELATED ART

A cable holder is widely used in an electrical connector for aligning or organizing a cable/cables. For example, U.S. Pat. No. 4,842,547 discloses such an electrical connector. The electrical connector includes a back shell or housing and a back shell cover plate, both typically fabricated of an electrically conductive material such as die cast zinc. Back shell cover plate is securable to the housing such as by screws passing through apertures of the back shell cover and being threaded into recesses of the housing. Within back shell is a terminal spacer block having a plurality of electric terminals secured therein. Each terminal has a mating portion and a conductor terminating portion. Conductors are terminated to the terminating portions of terminals. A cable receiving opening is located in the housing. A somewhat circular opening is located in the back shell cover plate spaced from the opening for cable to pass through and the back shell can be used as a cable holder. U.S. Pat. No. 5,074,808 discloses another electrical connector. The connector includes additional plastics material at a rear of the housing block imbedding the ground bus and a portion of each cable, and a conductive, bipartite, back shell enclosing the plastics material. In the shell, the plastics material conforms to an interior of the shell. The back shell includes a shell portion and a cover portion secured together by fasteners. The cables, including the signal wires and the ground wires are bent in arcs that are imbedded in the plastics material. A side of the shell receives the cables and the wires and through an opening. The side of the shell can be served for a cables holder.

However, the cable holders referred to hereinbefore are molded together with the housing or the shell, and those kinds of cable holders are not easily replaced and not universal. So, those kinds of cable holders are not convenient for users.

Hence, an improved cable connector assembly is provided in the present invention to address the problems mentioned above and meet the current trend.

BRIEF SUMMARY OF THE INVENTION

Accordingly, an object of the present invention is to provide a cable connector assembly with a holder which organizes cables for users using the cable connector assembly conveniently.

In order to achieve the above-mentioned object, a cable connector assembly in accordance with the present invention can mate with a complementary connector and comprises a metal housing defining a receiving space, a printed circuit board retained in the receiving space, at least one cable electrically connecting with the the printed circuit board, a latch mechanism comprising a latch member assembled to the metal housing and a holder. The latch member comprises an engaging portion engaging with the metal housing and a latch portion extending forwardly from the engaging portion for latching with the complementary connector. The holder includes a bottom wall, a pair of side walls extending upwardly from two sides of the bottom wall cooperatively to form a roomage to receive the metal housing and the cable.

Other objects, advantages and novel features of the invention will become more apparent from the following detailed description of the present embodiment when taken in conjunction with the accompanying drawings.

DETAILED DESCRIPTION OF THE INVENTION

Figure 1:
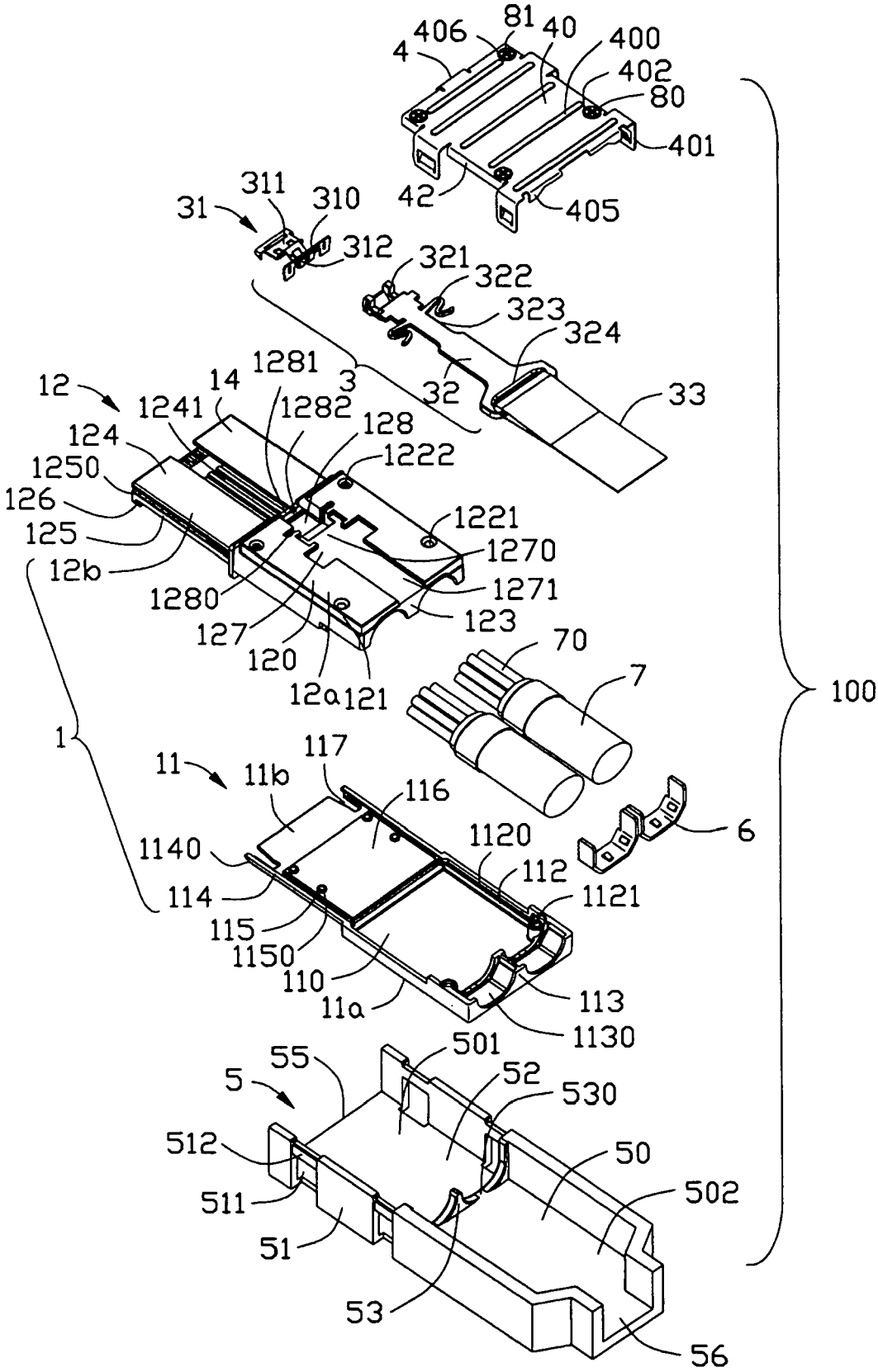
FIG. 1 is an exploded, perspective view of a cable connector assembly in accordance with the present invention.

Reference will now be made to the drawing figures to describe the present invention in detail.

Referring to FIGS. 1–5, a cable connector assembly 100 in accordance with the present invention comprises a metal housing 1, a printed circuit board (PCB) 2 located in the metal housing 1, a pair of cables 7 with cable holders 6 electrically connecting with the PCB 2, a latch mechanism 3 assembled to the metal housing 1, a metal shell 4 assembled to the metal housing 1 to partially cover the latch mechanism 3 and a holder 5 used for aligning and holding the cables 7 assembled to the metal housing 1.

The metal housing 1 comprises a base 11, a cover 12 engaging with the base 11 and a receiving space 15 formed therebetween. The receiving space 15 is for receiving the PCB 2.

The base 11 comprises a first base section 11*a* and a first tongue section 11*b* extending forwardly from the first base section 11*a*. The first base section 11*a* comprises a first flat portion 110, a pair of first flanges 112 and a first rear wall 113 extending upwardly from opposite side edges and rear edge of the first flat portion 110, respectively. The front portions of the first flanges 112 are cut to present the first flanges 112 L-shaped. A pair of substantially semicircular first openings 1130 are defined in the first rear wall 113 and a pair of first screw holes 1121 are defined in the first flanges 112 and adjacent to the first rear wall 113. A first slit 1120 extends downwardly from top surfaces of the first flanges 112 and the first rear wall 113. The first tongue section 11*b* comprises a first panel 116 formed with a pair of ribs 114 located at opposite sides thereof. Each rib 114 forms a tip end 1140 extending beyond a front edge of the first panel 116. The first panel 116 also forms two pairs of standoffs 115 spaced arranged thereon, and each standoff 115 defines a first positioning hole 1150 therein. A pair of U-shape cutouts 117 extend rearwardly from the front edge of the first panel 116 and respectively locate adjacent to corresponding ribs 114.

The cover 12 comprises a second base section 12*a* and a second tongue section 12*b* extending forwardly from the second base section 12*a*. The second base section 12*a* comprises a second flat portion 120, a pair of second flanges 122 and a second rear wall 123 extending downwardly from opposite side edges and a rear edge of the second flat portion 120. The rear portions of the second flanges 122 and the second rear wall 123 are cut to present the second flanges 122 L-shaped. A pair of substantially semicircular second openings 1230 are defined in the second rear wall 123. A pair of second screw holes 1221 are defined in the second flanges 122 and adjacent to the second rear wall 123. Another pair of third screw holes 1222 are defined in the front section of the second flat portion 120. Corresponding to the first slit 1120 of the base 11, a continuous protruding ridge 1220 integrally extends downwardly from inner edges of the second flanges 122 and the second rear wall 123. The second flat portion 120 defines a first recess section 127 and a deeper and narrower second recess section 128. The first recess section 127 comprises different-size first and second recesses 1270, 1271. The second recess section 128 formed in a front portion of the second flat portion 120 communicates with a front surface of the second flat portion 120. A deeper slit 1280 is defined in the front portion of the second flat portion 120 and extends in a direction perpendicular to that of the second recess section 128 to communicate with the second recess section 128. A transversely-extending bar 1281 is formed at a front end of the second recess section 128 with a pair of projections 1282 arranged thereon. A pair of channels 121 are respectively defined in opposite sides of the second flat portion 120 extending in a back-to-front direction.

The second tongue section 12*b* comprises a second panel 124 formed with three long keyways 1241 and a pair of side walls 125 extending downwardly from opposite sides of the second panel 124. A pair of second channels 1250 are defined in corresponding side walls 125 opened toward outside for guiding an insertion of a complementary connector (not shown). A pair of protrusions 126 extend rearwardly from a front surface of the second tongue section 12*b* and respectively locate below the side walls 125 to form a pair of gaps 1260 therebetween. Two pairs of positioning posts 1240 are symmetrically arranged on the second panel 124 and extending downwardly therefrom. The standoffs 115 with the positioning holes 1150 and the positioning posts 1240 are served as first engaging means of the housing 1. The first engaging means is not limited to the structures described above, it also can be protrusions protruding from the first and second tongue sections 11*b*, 12*b*, or recesses recessed from the first and second tongue sections 11*b*, 12*b*.

The PCB 2 is formed with a plurality of first conductive pads 21 aligned at a front end thereof and a plurality of second conductive pads 22 aligned at an opposite rear end thereof. The first and second conductive pads 21, 22 electrically connect with one another through inner traces disposed in the PCB 2. Two pairs of holes 23 are symmetrically arranged on the PCB 2 adjacent to the first conductive pads 21. The holes 23 are served as second engaging means of the PCB 2. The second engaging means is also not limited to the structures described above, it can be standoffs with holes to receive the respective protrusions of the first engaging means of the housing 1, or different-shape projections formed on opposite surfaces of the PCB 2 to be received in the recesses of the first engaging means of the housing 1.

The latch mechanism 3 comprises a latch member 31 latching with the complementary connector, a pull member 32 cooperating with the latch member 31 to actuate the latch member 31 to unlatch from the complementary connector and a pull tape 33 assembled to the pull member 32.

The latch member 31 is made of metal material and is a cantilever-type member. The latch member 31 comprises an N-shape engaging portion 310 located in a vertical surface, a flat latching portion 311 located in a horizontal surface perpendicular to the vertical surface and an inclined connecting portion 312 connecting the engaging portion 310 with the latching portion 311 to provide spring force to the latch member 31. The engaging portion 310 comprises a transverse bar section 3101 and a pair of side sections 3102 extending downwardly from opposite sides of the bar section 3101. Each side section 3102 is formed with barbs 3103 on outmost edge thereof. The flat latching portion 311 defines a pair of rectangular holes 3110 at a rear portion thereof adjacent to the connecting portion 312 and a pair of latches 3112 bending downwardly from opposite sides of the front edge thereof. The connecting portion 312 connects with middle portion of the bar section 3101 and extends upwardly from a lower edge of the bar section 3101. The connecting portion 312 also defines a hole 3120 therein for adjusting spring force of the latch member 31 by changing size and shape of the hole 3120.

The pull member 32 is made by insulative material and comprises a cooperating portion 321, an elongated intermediate portion 323 extending rearwardly form the cooperating portion 321 and forming with an interference portion 322, and a substantially rectangular-shape operating portion 324 formed at a rear end of the intermediate portion 323. The interference portion 322 comprises a pair of stop sections 3221 formed at opposite sides of the intermediate portion 323 and located adjacent to the cooperating portion 321 and a pair of elastic sections 3220 located adjacent to the stop sections 3221. Each elastic section 3220 comprises a transverse block section 3222 and a V-shape claw section 3223 extending rearwardly from the transversal block section 3222. The cooperating portion 321 comprises a vertical section 3210 connecting the cooperating portion 321 with the intermediate portion 323 and a body section 3211 extending forwardly from a lower edge of the vertical section 3210. The body section 3211 forms a pair of upwardly extending ribs 3212 with tip end formed with enlarged protrusions 3213. A slanted surface 3215 downwardly and rearward extends from a front surface of the body section 3211. The pull tape 33 is flexible and tied to a slot 3240 defined in the operating portion 324.

The metal shell 4 comprises a body portion 40 formed with a plurality of bars 400 on a top surface for increasing friction and a pair of lateral walls 42 extending downwardly from opposite sides of the body portion 40. A pair of first through holes 402 and another pair of second through holes 406 are respectively defined in the rear portion and the front portion of the body portion 40. Two pair of ear portions 401 adjacent to the lateral walls 42 extend downwardly from two sides of the body portion 40 respectively. Each ear portion 401 has a spring tab 403 extending inwardly and upwardly therefrom. A slant first tab 404 and a pair of second tabs 405 respectively extend downwardly from a front edge and a rear edge of the body portion 40.

The holder 5 is made by insulative material and comprises a bottom wall 52, a pair of side walls 51 extending upwardly from two sides of the bottom wall 52, thus, cooperatively forming a roomage 50. The roomage 50 is divided into a first roomage portion 501 with a front opening 55 and a second roomage portion 502 with a relative small rear opening 56 by a clapboard 53. However, the facing direction of the rear opening 56 is not limited to front-to-back direction, and the rear opening 56 of the roomage is capable of being angled with predetermined angle relative to the second roomage portion 502. So the facing direction of the rear opening 56 can be adjusted according with different requirements. A pair of substantially semicircularity third openings 530 are juxtaposed defined in the clapboard 53. Two pair of slots 511 are respectively defined in the front part of the side walls 51 and each slot 511 forms a block 512 therein.

Figure 2:
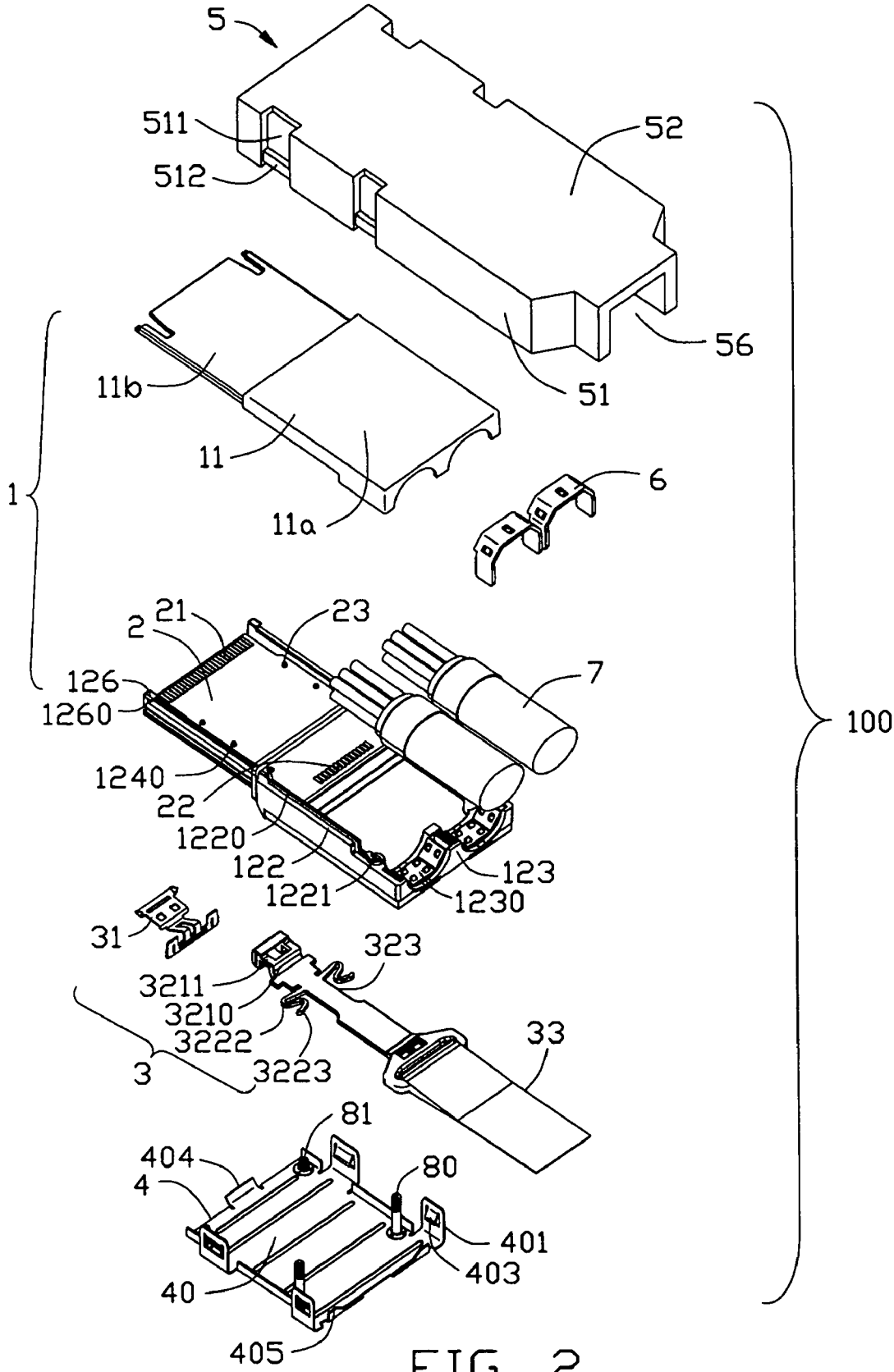
FIG. 2 is a view similar to FIG. 1, but viewed from different angle.
Figure 3:
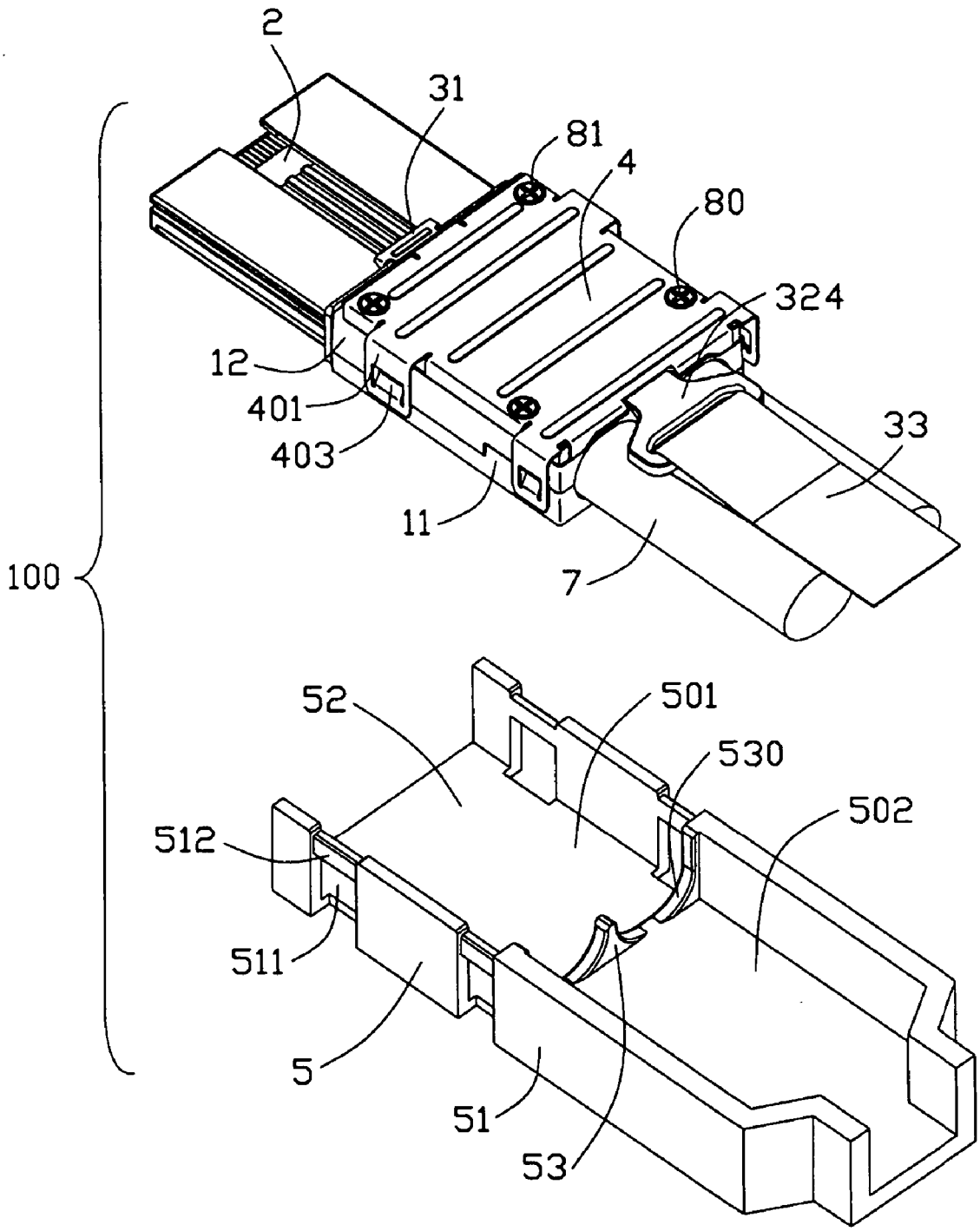
FIG. 3 is a partially assembled view of the cable connector assembly of FIG. 1.
Figure 4:
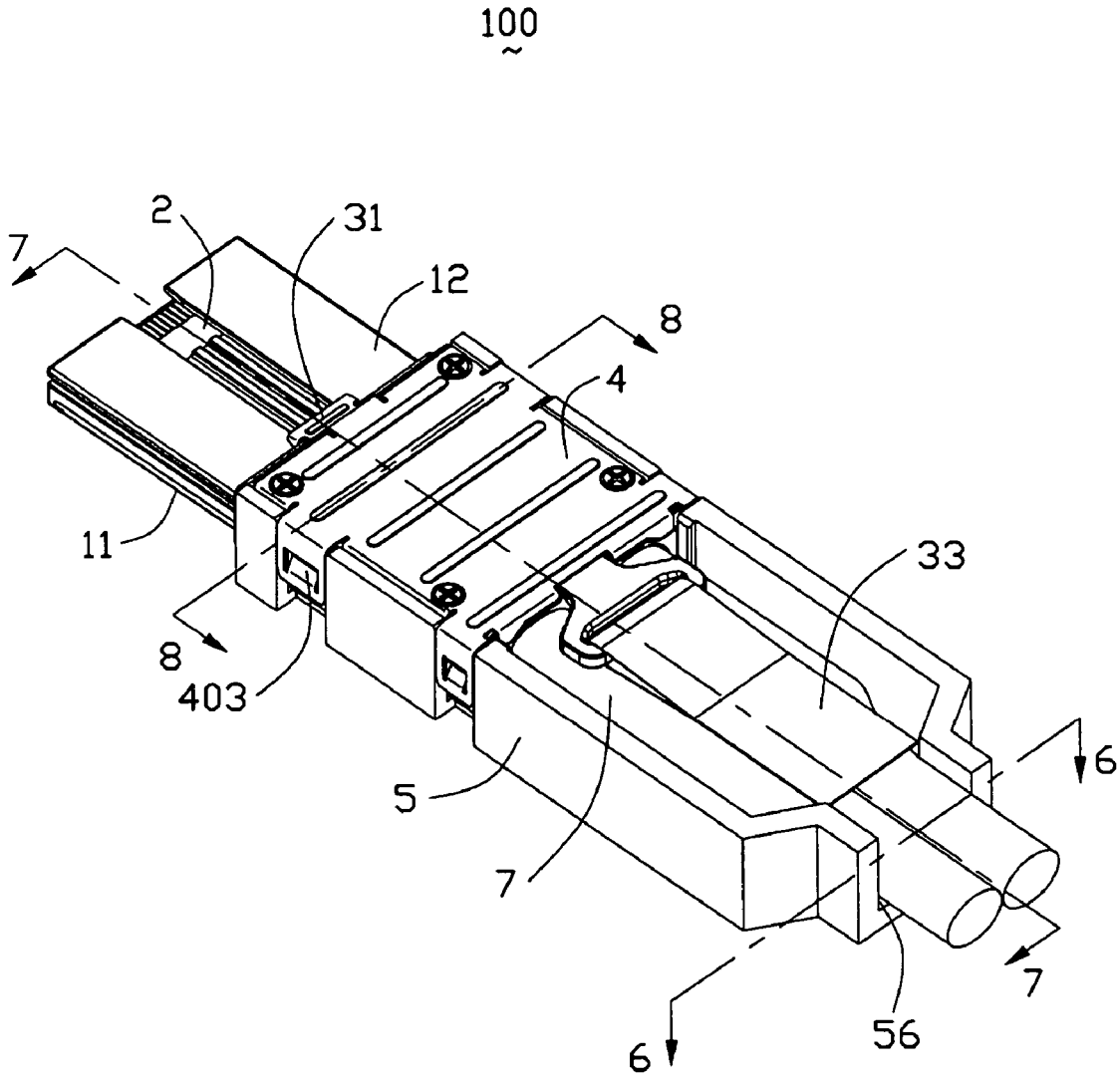
FIG. 4 is an assembled view of the cable connector assembly of FIG. 1.
Figure 5:
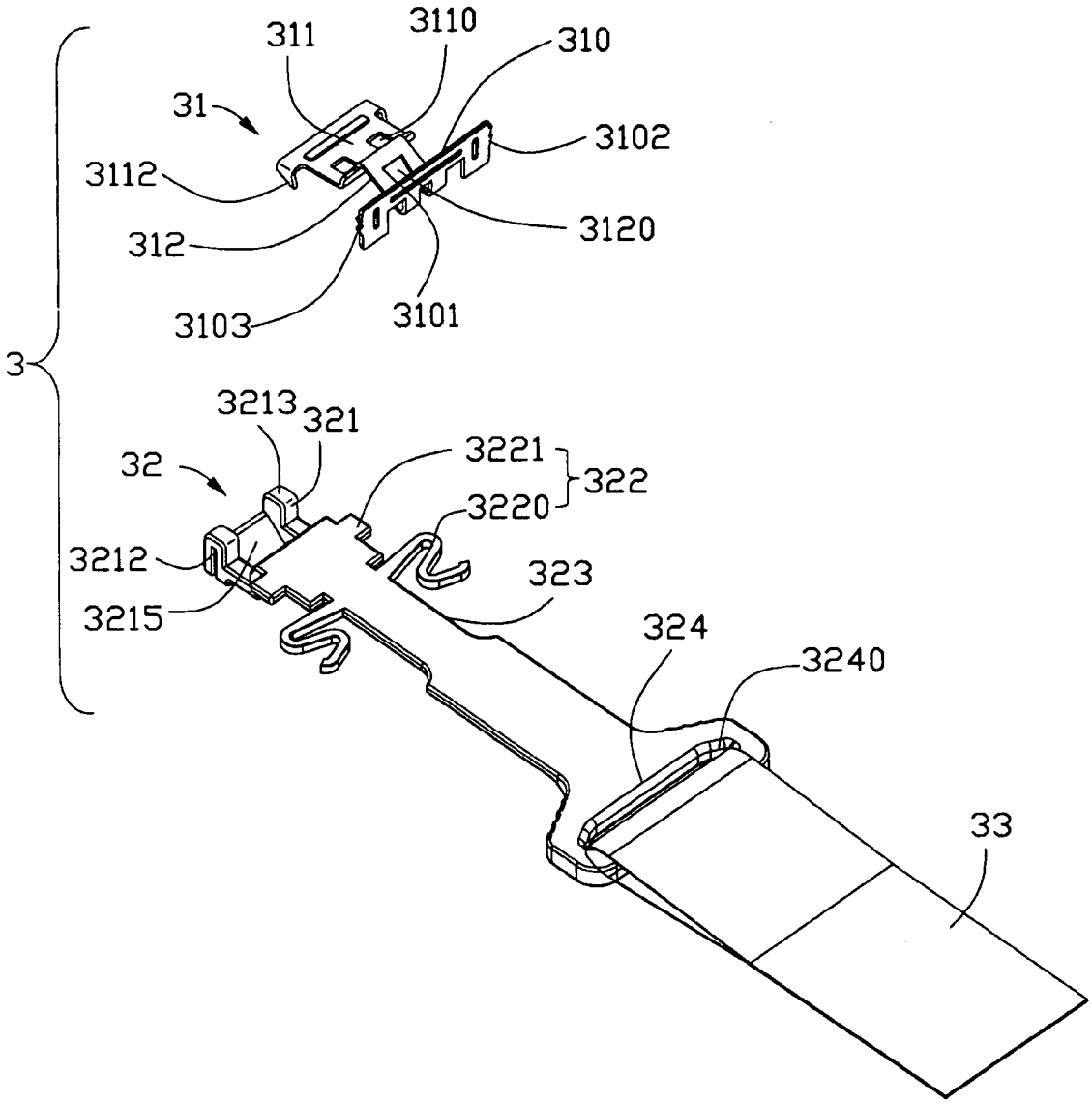
FIG. 5 is an enlarged view of latch mechanism of FIG. 1.
Figure 6:
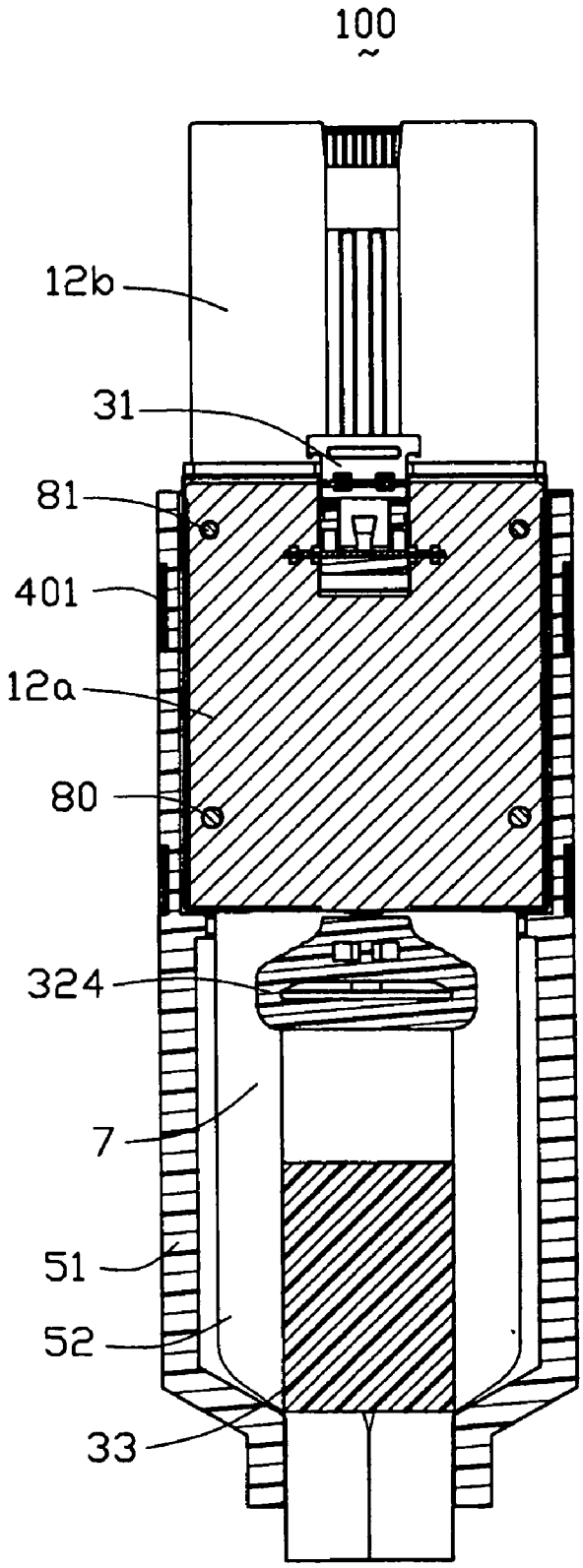
FIGS. 6–8 are cross-section views taken along lines 6—6 to 8—8 of FIG. 4.
Figure 7:
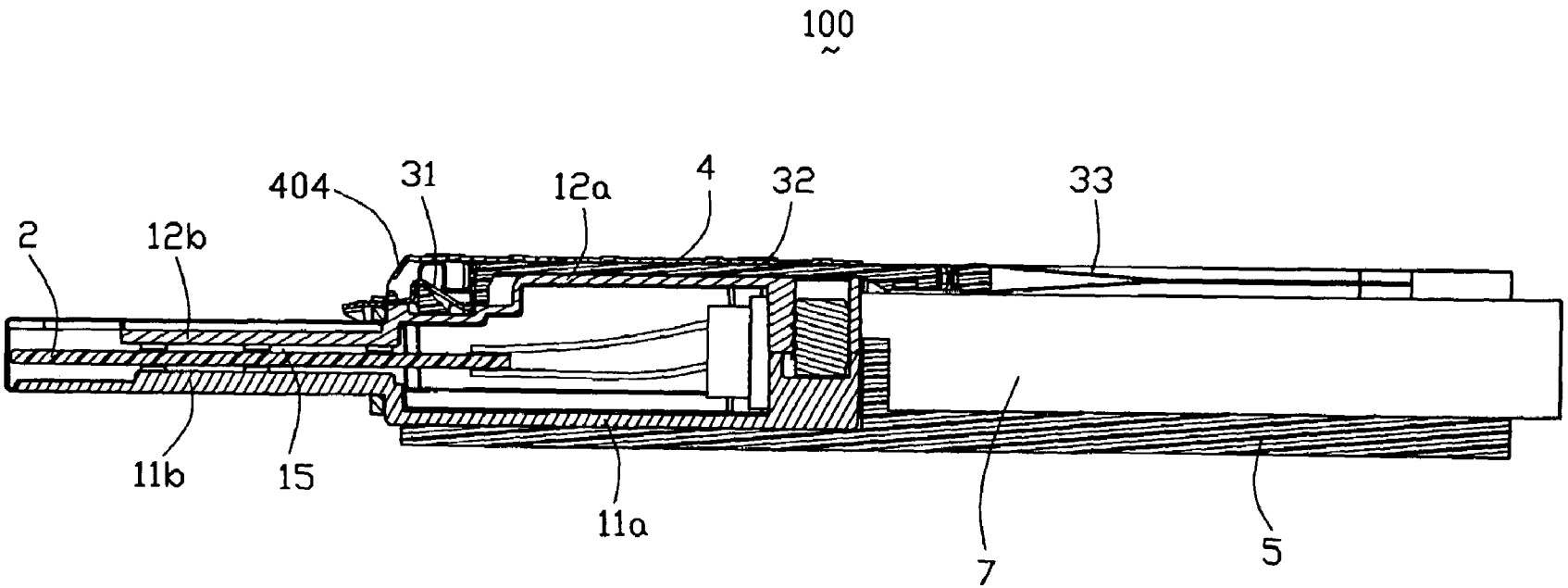
Figure 8:
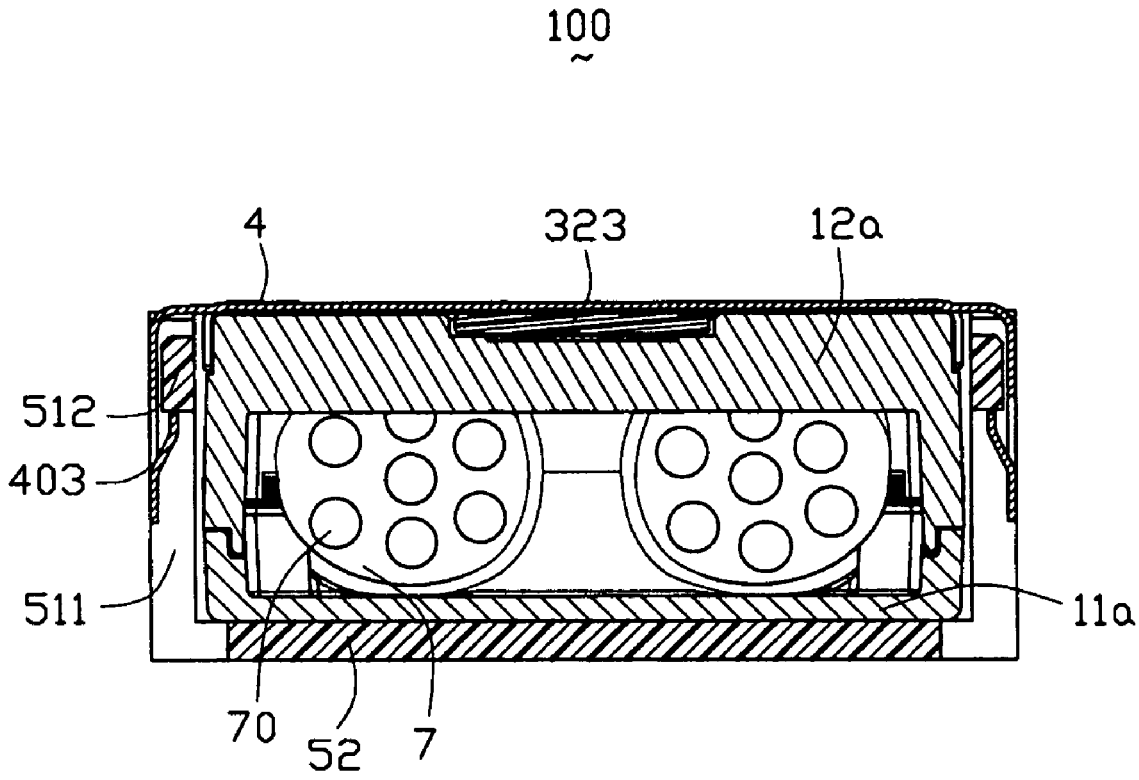

Referring to FIGS. 3, 4, 6, 7 and 8, in conjunction with FIGS. 1, 2 and 5, in assembly, conductors 70 of the cables 7 are respectively soldered to the second conductive pads 22 of the PCB 2. The PCB 2 with the juxtaposed arranged cables 7 are located on the second standoffs of the cover 12 with the positioning posts 1240 protruding through the holes 23 of the PCB 2 and the cables 7 located in the second semicircular openings 1230 of the cover 12. The cable connector assembly 100 of the present invention may have the cable holders 6 grasping metal braiding areas exposed outside of the cables 7 to provide strain relief to the cables 7. The base 11 is assembled to the cover 12 with the positioning holes 1150 aligning with the positioning posts 1240 and combining together to position the PCB 2 in the receiving space 15 of the housing 1. The PCB 2 is sandwiched between the base 11 and the cover 12 by the first and the second engaging means engaging with each other. The protruding ridge 1220 of the cover 12 is received in the first slit 1120 of the base 11 and the pair of tip ends 1140 is received in the gaps 1260, thus, the base 11 and the cover 12 are also securely assembled together, with the first screw holes 1121 aligning with the second screw holes 1221, and the cables 7 extending outwardly through circular openings formed by the substantially semicircular first openings 1130 and the substantially semicircular second openings 1230.

The latch mechanism 3 is assembled to the second base section 12*a* of the cover 12 along a vertical direction perpendicular to the front-to-back direction. The pull member 32 is firstly pressed to the cover 12. The cooperating portion 321 of the pull member 32 is received in the second recess section 128 of the cover 12, and the intermediate portion 323 with the interference portion 322 are received in the first recess section 127. The stop sections 3221 and the elastic sections 3220 are respectively sliderably received in the different-size first and second recesses 1270, 1271 with the block sections 3222 and claw section 3223 respectively abutting against opposite edges of the large-size second recesses 1271. The latch member 31 is assembled to the cover 12 along the vertical direction and the engaging portion 310 is interferentially received in the slit 1280. The inclined connecting portion 312 is located on the slanted surface 3215 of the body section 3211 of the cooperating portion 321. The bar section 3101 of the latch member 31 is located on the ribs 3212 with the enlarged protrusions 3213 located in front of the bar section 3101. The projections 1282 of the cover 12 are respectively received in the rectangular holes 3110 and the latches 3112 exposed above the second tongue section 12*b*.

When the complementary connector mates with the cable connector assembly 100 of the present invention, contacts of the complementary connector may electrically connect with the first conductive pads 21 of the PCB 2 with corresponding structure thereof latches with the latches 3112 of the latch member 31. When the cable connector assembly 100 disengages from the complementary connector, a rearward pull force exerts to the pull tape 33 to actuate the pull member 32 rearwardly moving with the elastic sections 3220 and the stop sections 3221 sliding in the first and second recesses 1271, 1270 until the enlarged protrusions 3213 abut against the bar section 3101 of the latch member 31. The body section 3211 also rearwardly moves with the slanted surface 3215 sliding along a bottom periphery of the inclined connecting portion 312, thus actuating the connecting portion 312 to pivot upwardly relative to the bar section 3101 of the engaging portion 310 and the latch section 311 with the latches 3112 to upwardly move to unlatch from the complementary connector. After the rearward pull force is removed, restore force of the elastic sections 3220 actuates the pull member 32 to move forwardly to its original position, and thus, the latch member 31 also reverts to its original position.

The metal shell 4 is assembled to the second base section 12*a* of the cover 12 with the lateral walls 42 sliderably received in the channels 121 of the cover 12 along a back-to-front direction. The slant first tab 404 is received in the second recess section 128 of the cover 12 and the second tabs 405 respectively locate on steps formed on rear edge of the cover 12. The first tab 404 locates above the latch member 31 to provide extra return force to the latch portion 311 of the latch member 31 when disengaging the cable connector assembly 100 from the complementary connector. A pair of first screws 81 are screwed through the holes 402 of the metal shell 4, the second screw holes 1221 of the cover 12 and the first screw holes 1121 of the base 11 to retain the metal shell 4 with the base 11 and the cover 12. A pair of secured screws 81 are screwed through the holes 406 of the metal shell 4 and the third screw holes 1222 to enhance the combination between the metal shell 4 and the housing 1.

The holder 5 is finally assembled to the housing 1. The ear portions 401 of the metal shell 4 insert into the slots 511, with the spring tabs 403 interferencially engaging with the blocks 512, thus, the holder 5 and the metal housing 1 connect together stably. The first base potion 11*a* and the second base portion 12*a* are received in the first roomage portion 501. The pair of cables 7 are disposed in the second roomage portion 502 and extending outwardly from the rear opening 56. Thus, the holder 5 is used for organizing the cables 7. The pull tape 33 is received in the upper portion of the second roomage portion 502 and accessible from the outside.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for mating with a complementary connector, comprising:

a metal housing defining a receiving space;

a printed circuit board retained in the receiving space of the metal housing;

at least one cable electrically connecting with the printed circuit board;

a latch mechanism comprising a latch member assembled to the metal housing, the latch member comprising an engaging portion engaging with the metal housing and a latch portion extending forwardly from the engaging portion for latching with the complementary connector;

a holder including a bottom wall, a pair of side walls extending upwardly from two sides of the bottom wall cooperatively to form a roomage to receive the metal housing and the cable; and a pull member cooperating with the latch member and a pull tape tied to the pull member: wherein the pull member is mounted on the metal housing and the pull tape is received in the roomage and accessible from outside.

2. The cable connector assembly as claimed in claim 1, wherein the roomage of the holder is divided into a first roomage portion with a broad front opening and a second roomage portion with a relative narrow rear opening, and wherein the rear opening of the roomage is capable of being angled with predetermined angle relative to the second roomage portion.

3. The cable-connector assembly as claimed in claim 2, wherein the holder forms a clapboard separating the roomage into the first roomage portion and the second roomage portion, and wherein the clapboard defines a pair of substantially semicircularity third openings juxtaposing thereon adapted for disposing the cables.

4. The cable connector assembly as claimed in claim 2, wherein the metal housing comprises a first base portion and a second base portion, and wherein the first base portion and the second base portion are both received in the first roomage portion of the holder.

5. The cable connector assembly as claimed in claim 1, wherein the engaging portion of the latch member forms a slanted portion extending rearwardly and upwardly, and wherein the pull member forms a cooperating portion with a slanted surface attaching to the slanted portion of the latch member and capable of sliding along the slanted portion to actuate the slanted portion to downwardly move relative to the engaging portion and the latch portion upwardly move for unlatching from the complementary connector.

6. The cable connector assembly as claimed in claim 5, wherein the cooperating portion forms a protrusion adjacent to the slanted surface, and wherein the protrusion abuts against the engaging portion with the rearward movement of the pull member to prevent the pull member from disengaging from the latch member.

7. The cable connector assembly as claimed in claim 1, wherein the metal housing comprises a base and a cover assembled to the base to form the receiving space.

8. The cable connector assembly as claimed in claim 7, wherein the cover forms first flanges with a protruding ridge and the cover forms second flanges defining a slit for receiving the protruding ridge.

9. The cable connector assembly as claimed in claim 7, wherein the cover and the base are combined together by screws.

10. The cable connector assembly as claimed in claim 7, wherein the base comprises a first base section and a first tongue section extending forwardly from the first base section, wherein the cover comprises a second base section and a second tongue section extending forwardly from the second base section.

11. The cable connector assembly as claimed in claim 7, wherein the cover comprises at least one positioning post and the base comprising at least one positioning bole for receiving the positioning post.

12. The cable connector assembly as claimed in claim 11, wherein the printed circuit board defines at least one hole for the positioning post passing through to position the printed circuit board in the receiving space.

13. The cable connector assembly as claimed in claim 1, wherein the engaging portion of the latch member locates in a first surface perpendicular to a top surface of the housing, and wherein the latch portion locates in a second surface parallel to the top surface and forms a latch extends vertically from the latch portion.

14. A cable connector assembly adapted for mating with a complementary connector, comprising:

a housing defining a receiving space;

a printed circuit board retained in the receiving space of the housing;

at least one cable electrically, connecting with the printed circuit board;

a latch mechanism comprising a latch member assembled to the metal housing, the latch member comprising an engaging portion engaging with the housing and a latch portion extending forwardly from the engaging portion for latching with the complementary connector; and a holder including a bottom wall, a pair of side walls extending upwardly from two sides of the bottom wall cooperatively to form a front roomage to receive the housing and a rear roomage to receive the cable extending rearward from the rear end of the housing; wherein a pull member cooperates with the latch member and is mounted to the housing while extending rearward into the rear roomage so as to be accessible from an exterior.

15. The cable connector as claimed in claim 14, wherein said holder is upwardly exposed to the exterior.

16. A cable connector assembly adapted for mating with a complementary connector, comprising:

a metal housing defining a receiving space;

a printed circuit board retained in the receiving space of the metal housing;

at least one cable electrically connecting with the printed circuit board;

a latch mechanism comprising a latch member assembled to the metal housing, the latch member comprising an engaging portion engaging with the metal housing and a latch portion extending forwardly from the engaging portion for latching with the complementary connector; and a holder including a bottom wall, a pair of side walls extending upwardly from two sides of the bottom wall cooperatively to form a roomage to receive the metal housing and the cable; further comprising a metal shell assembled to the metal housing.

17. The cable connector assembly as claimed in claim 16, wherein the metal shell comprises a body portion with at least one pair of ear portions extending downwardly from two sides of the body portion and each ear portion forms a spring tab, and wherein each side wall of the holder defines at least one slot and the slot forms a block for engaging with the spring tab of the metal shell.

18. The cable connector assembly as claimed in claim 16, wherein the metal shell forms a first tab at front edge of the body portion located above the latch portion of the latch member, and wherein the first tab is capable of providing extra return force to the latching member when disengaging the cable connector assembly from the complementary connector.

* * * * *